United States Patent [19]

Gelina

[11] Patent Number: 4,900,023

[45] Date of Patent: Feb. 13, 1990

[54] GOLF PUTTING AID

[76] Inventor: Anthony L. Gelina, 6511 Del Matro Ave., Des Moines, Iowa 50311

[21] Appl. No.: 322,177

[22] Filed: Feb. 13, 1989

[51] Int. Cl.[4] ..... A63B 69/36; A63B 57/00

[52] U.S. Cl. ..... 273/34 B; 273/180

[58] Field of Search ..... 273/34 B, 180, 178 R, 273/178 A, 178 B, 176 J, 176 B, 176 H, DIG. 8, 177 R, 177 B

[56] References Cited

U.S. PATENT DOCUMENTS 3,464,704 9/1969 Nelson ..... 273/180

4,280,698 7/1981 Trojano ..... 273/34 B

FOREIGN PATENT DOCUMENTS 220377 8/1924 United Kingdom ..... 273/34 B

*Primary Examiner*—George J. Marlo

*Attorney, Agent, or Firm*—Zarley, McKee, Thomte, Voorhees & Sease

[57] ABSTRACT

A golf cup insert having a hollow cylindrical first body member having an outer diameter and an inner diameter with the outer diameter being complementary to the inside diameter of an conventional golf putting cup. The inner diameter of the first body member is greater than the diameter of a conventional golf ball. The body member is frictionally held within the top portion of the golf putting cup through the engagement of the outer diameter of the body member frictionally engaging the inside diameter of the golf putting cup. A second hollow cylindrical body member is positioned within the inner diameter of the hollow cylindrical first body member. The inner diameter of the second body member is slightly greater than the diameter of a conventional golf ball. Both the first and second body members are preferably comprised of a sponge rubber material.

7 Claims, 1 Drawing Sheet

GOLF PUTTING AID

BACKGROUND OF THE INVENTION

Both amateur golfers have used prior art devices to increase their putting proficiency by utilizing golf cup inserts or the like which decrease the effective top openings of a conventional golf cup. With the size of the golf cup reduced, the putting proficiency of the golfer may be increased by forcing the golfer to putt the golf ball into the center of the cup through a smaller aperture. Such devices are shown in British Patent specification No. 220,377 dated Aug. 15, 1924, and U.S. Pat. No. 4,280,698 issued July 28, 1981.

These prior art devices are not adaptable to easily concentrically varying the size of the reduced putting aperture. Their attachment to a conventional golf cup is either difficult or unstable, and the attaching process can skew or damage the golf cup insert.

It is, therefore, a principal object of this invention to provide a golf cup insert to decrease the effective size of a conventional golf cup which can be easily inserted into the top of a conventional golf cup.

It is a further object of this invention to provide a golf cup insert which can be easily frictionally engaged, and then disengaged from a conventional golf cup.

It is still a further object of this invention to provide a golf cup insert wherein the effective size of the golf cup can be easily varied.

These and other objects will be apparent to those skilled in the art.

SUMMARY OF THE INVENTION

The golf cup insert disclosed herein comprises a hollow cylindrical first body member having an outer diameter and an inner diameter with the outer diameter being complementary to the inside diameter of an conventional golf putting cup. The inner diameter of the first body member is greater than the diameter of a conventional golf ball. The body member is frictionally held within the top portion of the golf putting cup through the engagement of the outer diameter of the body member frictionally engaging the inside diameter of the golf putting cup.

A second hollow cylindrical body member is positioned within the inner diameter of the hollow cylindrical first body member. The inner diameter of the second body member is slightly greater than the diameter of a conventional golf ball.

Both the first and second body members are preferably comprised of a sponge rubber material.

DESCRIPTION OF THE PREFERRED EMBODIMENT

Figure 4:
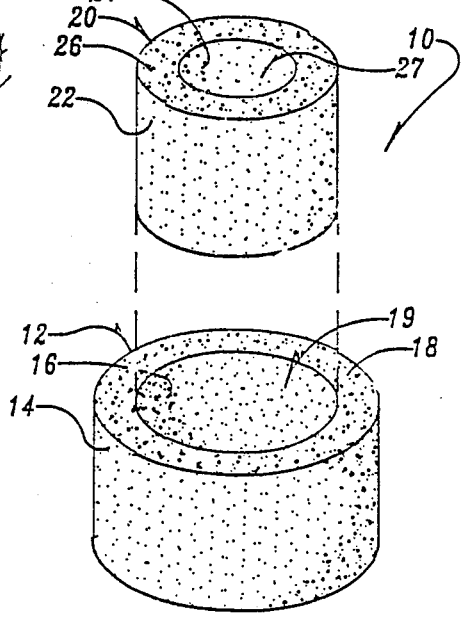
FIG. 4 is an exploded view showing the first and second body members which comprise the device of FIG. 1.

The numeral 10 designates the golf cup insert of this invention comprised of a first body member 12 having an outer diameter cylindrical surface 14, an inner diameter cylindrical surface 16, a top surface 18, and a center opening 19 (see FIG. 4).

A second body member 20 has an outer diameter cylindrical surface 22, an inner diameter cylindrical surface 24, a top surface 26, and a center opening 27. The outer diameter cylindrical surface 22 of second body member 20 is the same size or slightly greater than the inner diameter cylindrical surface 16 of the first body member 12. This is to permit the second body member to be frictionally inserted into the center opening 19 of the first body member 12.

The center opening 19 of first body member 12 and the center opening 27 of the second body member 20 are greater than the diameter of a conventional golf ball.

A conventional golf putting cup 28 has a flat top 30, a cylindrical sidewall 32 and a bottom 34. The golf putting cup 28 is conventionally inserted to be coplanar within conventional grass putting green 36. A conventional golf ball is designated by the numeral 38.

Figure 1:
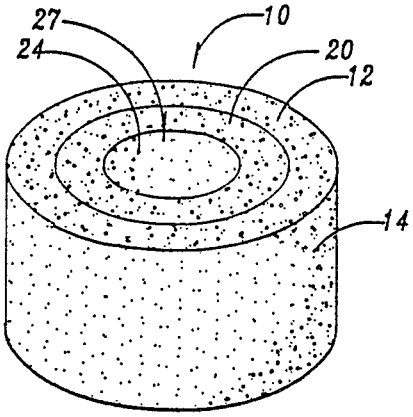
FIG. 1 is a perspective view of the golf cup insert of this invention.
Figure 2:
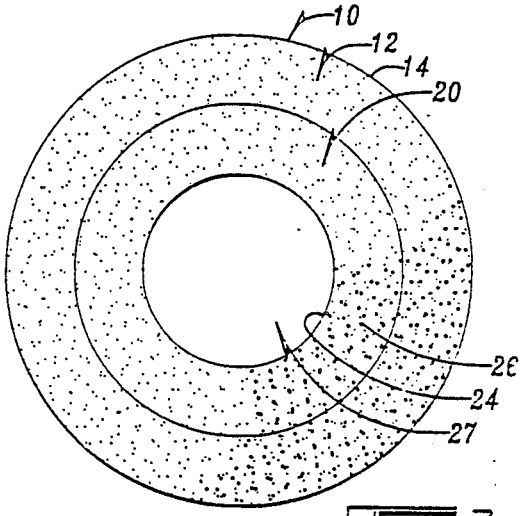
FIG. 2 is a top plan view at an enlarged scale of the device of FIG. 1.
Figure 3:
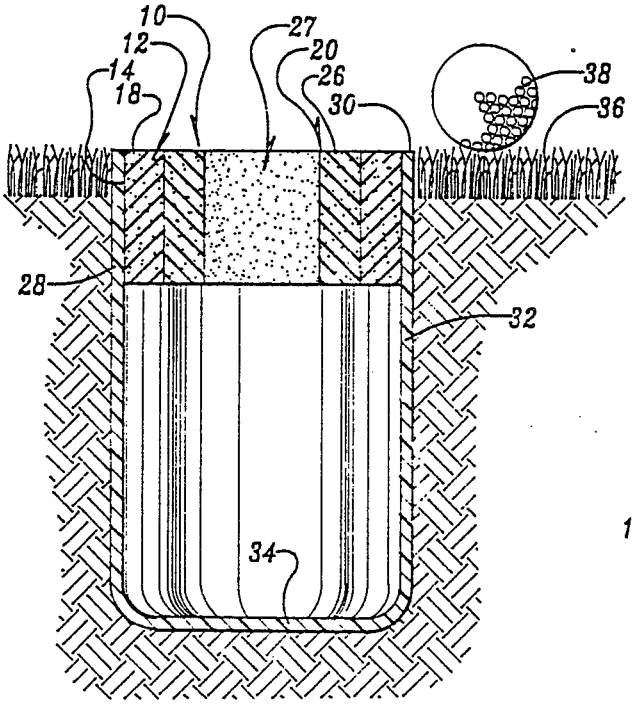
FIG. 3 is a vertical sectional view of a conventional golf putting cup with the insert of FIG. 1 inserted in the top portion thereof.

In operation, the golf cup insert 10, which has an outer diameter cylindrical surface 14 equal to or slightly greater than the inner diameter of the golf putting cup 28, is frictionally inserted into the top of the golf putting cup as illustrated in FIG. 3. The frictional engagement of the insert 10 within the cup 28 is effected by a slight compression in the material of the first body member 12.

If the golfer wishes to practice putting with a putting aperture equal to the inner diameter 16 of the first body member 12, the second body member 20 is removed from the inner diameter cylindrical surface 16 of the first body member. However, if the golfer wishes to even further reduce the effective size of the golf cup opening, the second body member is inserted within the first body member as described heretofore. In the first instance, the effective putting aperture is represented by the center opening 19 of the first body member 12. In the second instance, the effective putting aperture is the center opening 27 of the second body member 20.

The golf cup insert 10 can be easily removed from the golf putting cup 28 by merely reaching through the center aperture of the body members 12 or 20 and exerting an upward force thereon.

The sponge rubber material of the first and second body members enhances and effects the frictional engagement of the golf insert within the golf putting cup, as well as effecting the frictional engagement of the second body member within the first body member.

Thus, from the foregoing, it is seen that this invention will achieve at least its stated objectives.

I claim:

1. An insert for a golf putting cup, comprising, a hollow cylindrical first body member having an outer diameter and an inner diameter, the outer diameter being complementary to the inside diameter of a conventional golf putting cup, the inner diameter being greater than the diameter of a conventional golf ball, said first body member having a vertical length of sufficient magnitude to permit said body member to be frictionally held within the top portion of said golf putting cup through the engagement of said outer diameter of said body member frictionally engaging the inside diameter of said golf putting cup and said first body member being comprised of a resilient sponge rubber material, and wherein said frictional engagement of said body member within said golf putting cup is created by the partial compression of the outer diameter of said first body member within said golf putting cup.

2. The device of claim 1 where a hollow cylindrical second body member is positioned within the inner diameter of said hollow cylindrical first body member, said second body member having an outer diameter and an inner diameter with said inner diameter of said second body member being greater than the diameter of a conventional golf ball.

3. The device of claim 2 wherein said second body member is comprised of a resilient sponge rubber material and wherein said second body member is frictionally mounted within the inner diameter of said first body member by the partial compression of the outer diameter of said second body member within the inner diameter of said first body member.

4. The device of claim 1 in combination with a golf putting cup having an open top in a horizontal plane, and a cylindrical sidewall extending downwardly therefrom to a bottom portion, with said first body member having a top portion dwelling in the horizontal plane of said golf putting cup.

5. The device of claim 4 where a hollow cylindrical second body member is positioned within the inner diameter of said hollow cylindrical first body member, said second body member having an outer diameter and an inner diameter with said inner diameter of said second body member being greater than the diameter of a conventional golf ball.

6. The device of claim 5 wherein said second body member has a top portion coplanar with the open top of said putting cup and the top portion of said first body member.

7. The device of claim 5 wherein said second body member is comprised of a resilient sponge rubber material and wherein said second body member is frictionally mounted within the inner diameter of said first body member by the partial compression of the outer diameter of said second body member within the inner diameter of said first body member.

* * * * *